United States Patent [19]

Saperstein et al.

[11] Patent Number: 4,615,385

[45] Date of Patent: Oct. 7, 1986

[54] HEAT EXCHANGER

[75] Inventors: Zalman P. Saperstein, Gurnee, Ill.; Russell C. Awe, New Berlin, Wis.; Norman F. Costello; Scott R. Larrabee, both of Racine, Wis.

[73] Assignee: Modine Manufacturing Inc., Racine, Wis.

[21] Appl. No.: 722,653

[22] Filed: Apr. 12, 1985

[51] Int. Cl.[4] ..... F28F 9/02

[52] U.S. Cl. ..... 165/175; 165/173

[58] Field of Search ..... 165/173, 174, 175

[56] Reference Cited

U.S. PATENT DOCUMENT 3,689,972 9/1972 Mosier et al. ..... 29/157.3 R

*Primary Examiner*—Stephen F. Husar

*Attorney, Agent, or Firm*—Wood, Dalton, Phillips, Mason & Rowe

[57] ABSTRACT

Improved resistance to pressure caused deformation in header and tank construction utilized in heat exchangers is achieved by providing domes, preferably exteriorally convex, in the header surfaces of the header and tank construction. These domes are located in the area between the holes in such constructions through which tubes extend.

2 Claims, 5 Drawing Figures

HEAT EXCHANGER

FIELD OF THE INVENTION

This invention relates to a heat exchanger, and more particularly, to a heat exchanger of the type provided with spaced header and tank constructions interconnected by generally parallel tubes.

BACKGROUND OF THE INVENTION

Many types of heat exchangers in use today employ two spaced header and tank constructions. Generally parallel, open ended tubes interconnect the header and tank constructions and are in fluid communication with the interior of each. In many cases, plate or serpentine fins are disposed across the tubes between the header and tank constructions. Typical examples of such heat exchangers are vehicular radiators and condensers, although such heat exchangers may be found in many other applications as well.

In manufacturing heat exchangers of this type, holes must be formed in the header surfaces of each of the header and tank constructions to receive the ends of the tubes. Most frequently this is accomplished by a punching operation wherein material is actually removed from the header surface at the hole location, but even where the hole is formed simply by piercing and deformation without material removal, the resulting lack of continuity in the header surface weakens the same.

Those skilled in the art will readily recognize that heat exchangers of the sort of concern are pressurized, that is, the heat exchange fluid within the tubes and the heater and tank constructions will be subjected to an elevated pressure. Because the header surface in the area of the holes is weakened during the formation of the holes, such elevated pressure may cause deformation in those areas. The deformation, in turn, can result in the formation of leakage openings at the joints between the tubes and the header surface. If the elevated pressure becomes extreme, rupture of the header surface can also occur.

The present invention is directed to overcoming one or more of the above problems.

SUMMARY OF THE INVENTION

It is a principal object of the invention to provide a new and improved heat exchanger of the type wherein generally parallel tubes extend between two header and tank constructions. More specifically, it is an object of the invention to provide a heat exchanger whose header surfaces are strengthened to provide increased resistance against deformation resulting from pressurization of a heat exchange fluid within the heat exchanger to avoid the formation of leakage paths and/or prevent rupture of the header.

An exemplary embodiment of the invention achieves the foregoing objects in a heat exchanger including a plurality of elongated tubes in generally parallel side-by-side relation. A header and tank construction receives the ends of the tubes and has plural spaced elongated holes in one side thereof through which the tubes pass.

The portions of the one side between the holes are formed as domes to thereby provide increased resistance to deformation as a result of a force exerted on such side by pressurized fluid within the header and tank construction.

In a preferred embodiment, the tubes employed are flattened tubes and the domes have a compound curvature as, for example, that of a nominal sphere.

In one embodiment of the invention, the header and tank construction is an integral element. Preferably, the integral element is an elongated tube which may be of generally circular cross section. According to another embodiment of the invention, the header and tank construction is defined by a header plate and a separate tank secured to and sealed against the header plate.

In a preferred embodiment, a gasket is interposed between an open sided tank and a header plate.

As a result of the use of the domes between the holes and the header surface, the weakness in such surface caused by the formation of the tube receiving holes is eliminated by providing a more pressure resistant configuration in the form of such domes.

Other objects and advantages will become apparent from the following specification taken in connection with the accompanying drawings.

DESCRIPTION OF THE PREFERRED EMBODIMENTS

Figure 1:
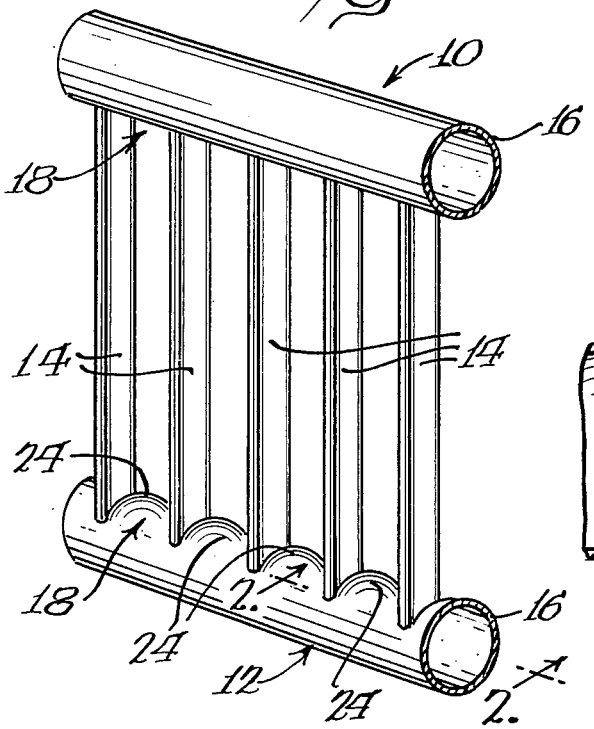
FIG. 1 is a perspective view of a heat exchanger made according to the invention.

An exemplary embodiment of a heat exchanger made according to the invention is illustrated in the drawings and with reference to FIG. 1 is seen to include an upper header and tank construction, generally designated 10 and a spaced, generally parallel lower header and tank construction, generally designated 12. Elongated, open ended oval or flattened tubes 14, in spaced, generally parallel relation extend between the header and tank constructions 10 and 12. Platelike or serpentine fins (not shown) may be disposed between the header and tank constructions 10 and 12 and in heat exchange relation with the tubes 14 in a conventional fashion as desired.

In the embodiment illustrated in FIGS. 1–4, each of the header and tank constructions 10 and 12 is formed of an integral element, namely, an elongated tube 16 of generally circular cross section. Suitable ports (not shown) are in fluid communication with the interior of each of the tubes 16.

The facing surfaces of the tubes 16 defining the upper and lower header and tank constructions 10 and 12 are indicated generally at 18 and are the header surfaces of each header and tank construction.

Figure 2:
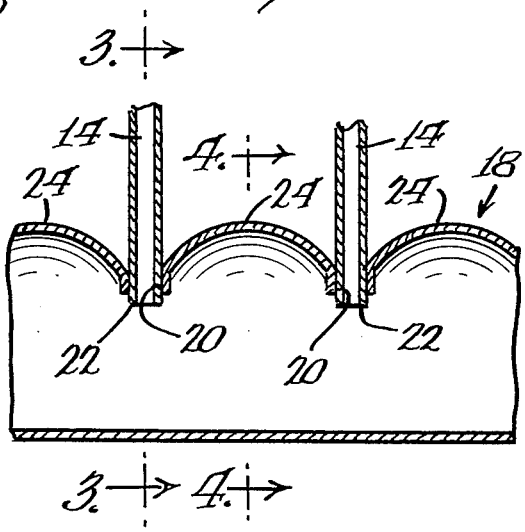
FIG. 2 is an enlarged, fragmentary sectional view taken approximately along the line 2—2 in FIG. 1.
Figure 3:
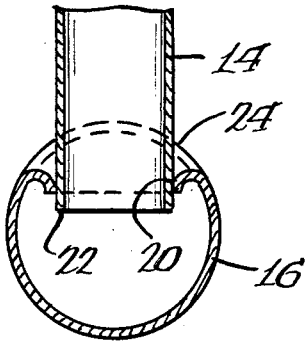
FIG. 3 is a sectional view taken approximately along the line 3—3 in FIG. 2.
Figure 4:
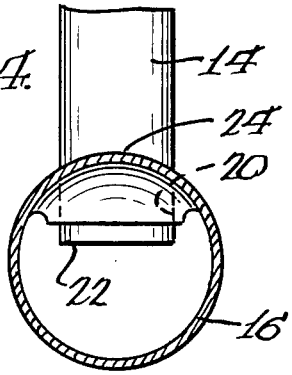
FIG. 4 is a further sectional view taken approximately along the line 4—4 in FIG. 2.

As seen in FIGS. 2 and 3, the header surfaces 18 are provided with a series of spaced, generally parallel, elongated holes 20 which receive the open ends 22 of the tubes 14. The tubes 14 will be sealed to the respective header and tank construction 10 or 12 within the holes 20 by any suitable means as well as bonded thereto sufficiently so as to provide structural integrity. Where metal components are used, solder or braze metal will conventionally be employed for the purpose.

According to the invention, the header surfaces 18, between the holes 20, are formed as exteriorally convex domes 24. Preferably, the domes 24 have a compound curve configuration, that is, have a curved appearance both circumferentially of the header and tank constructions 10 and 12 (see FIG. 4) and axially of the length of the header and tank constructions 10 and 12 (see FIG. 2). In a highly preferred embodiment, the domed configuration will nominally be that of a portion of a sphere.

Depending upon the material of which the header and tank construction 10 and 12 is formed, the domes 24 may be provided in the surfaces 18 by stamping, molding or the like.

Figure 5:
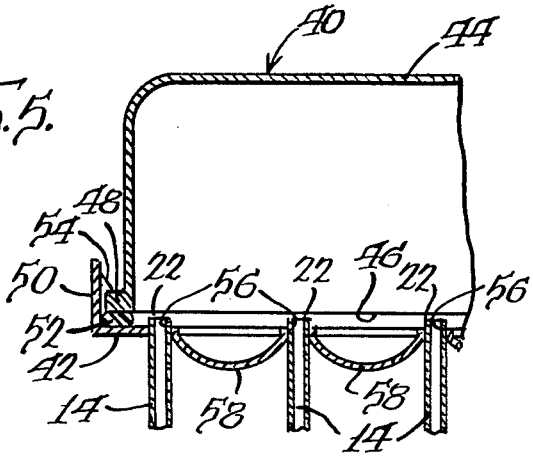
FIG. 5 is an enlarged, fragmentary sectional view of a modified embodiment of the invention.

FIG. 5 shows an alternative embodiment of the invention. The flattened tubes are shown at 14 as in FIGS. 1–4 whereas an upper header and tank construction is shown generally at 40. In the case of the embodiment of FIG. 5, the header and tank construction 40 is formed of a number of components including a header plate 42 and a tank 44 of metal or plastic. The tank 44 has an open side at 46 and is surrounded by an outwardly directed peripheral flange 48. The header plate 42 has an upturned peripheral flange 50. The tank 44 is placed within the flange 50 against a compressible gasket or O-ring 52 which is compressed until sealing contact between both the tank 44 and the header plate 42 is obtained. A series of fingers 54 are deformed from the header plate flange 50 toward the tank 44 to overlie and retain the flange 46 in any of a variety of ways known in the art.

The header plate 42 includes spaced, generally parallel, elongated openings 56 which receive the open ends 22 of the tubes 14. Again, the tubes 14 are sealed and bonded to the header plate 42 at the opening 56. Exteriorally convex domes 58 of the same general configuration as the domes 24 are disposed in the header plate 42 between the holes 56.

The domes 24 and 58 provide improved resistance to pressure deformation at the areas between the tubes 14 as a result of pressurized fluid within the header and tank constructions 10, 12 and 40. Mathematical analysis has illustrated that the domes at least double the strength of the header surfaces in the areas where they have been weakened by the formation of the holes 20 and 56 had such areas not been formed of domes and left in cylindrical or planar configuration. Consequently, leakage openings resulting from pressure caused deformation are avoided and the possibilities of rupture substantially reduced.

What is claimed is:

1. A heat exchanger comprising:

spaced generally parallel header and tank constructions;

each of said header and tank constructions having elongated, spaced, tube receiving holes in a header surface thereof;

the holes in one header surface being aligned with and facing corresponding holes in the other header surface; and elongated open ended, flattened tubes extending between and into said header and tank constructions through aligned ones of said holes;

the portions of each header surface between said holes including exteriorly convex domes defined by compound curves to thereby provide increased resistance to deformation as a result of force exerted by a pressurized fluid within said header and tank construction.

2. The heat exchanger of claim 1 wherein said compound curves are nominal spheres.

* * * * *

US004615385B1

REEXAMINATION CERTIFICATE (2440th)

United States Patent [19]

Saperstein et al.

[11] B1 4,615,385

[45] Certificate Issued Dec. 20, 1994

[54] HEAT EXCHANGER

[75] Inventors: Zalman P. Saperstein, Gurnee, Ill.; Russell C. Awe, New Berlin, Wis.; Norman F. Costello; Scott R. Larrabee, both of Racine, Wis.

[73] Assignee: Modine Manfacturing Company, Racine, Wis.

Reexamination Requests:
No. 90/002,093, Jul. 23, 1990
No. 90/002,479, Oct. 15, 1991

Reexamination Certificate for:
Patent No.: 4,615,385
Issued: Oct. 7, 1986
Appl. No.: 722,653
Filed: Apr. 12, 1985

[51] Int. Cl.[5] ..... F23F 9/02
[52] U.S. Cl. ..... 165/175; 165/173; 165/906
[58] Field of Search ..... 165/173, 175, 152, 153, 165/151, 906; 29/890.052, 890.043, 890.044

[56] References Cited

U.S. PATENT DOCUMENTS

| | | | |
|---|---|---|---|
| 1,633,664 | 6/1927 | Harnett | 165/151 |
| 2,184,658 | 12/1939 | Young | 165/151 |
| 3,487,668 | 1/1970 | Fuchs, Jr. | 83/53 |
| 3,689,972 | 9/1972 | Mosier et al. | 29/890.043 |
| 4,332,293 | 6/1982 | Hiramatsu | 165/153 |
| 4,373,369 | 2/1983 | Schey | 72/347 |

FOREIGN PATENT DOCUMENTS

| | | | |
|---|---|---|---|
| 891483 | 9/1953 | Germany | 29/890.043 |
| 54-122456 | 8/1979 | Japan . | |

*Primary Examiner*—Albert W. Davis, Jr.

[57] ABSTRACT

Improved resistance to pressure caused deformation in header and tank construction utilized in heat exchangers is achieved by providing domes, preferably exteriorally convex, in the header surfaces of the header and tank construction. These domes are located in the area between the holes in such constructions through which tubes extend.

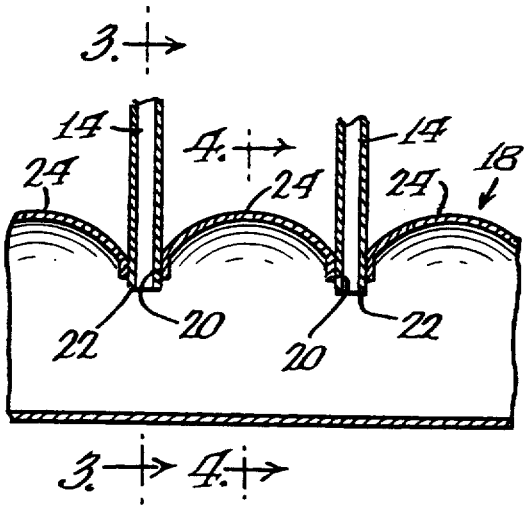

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claim 2 dependent on an amended claim, is determined to be patentable.

New claims 3–5 are added and determined to be patentable.

1. A heat exchanger comprising:

spaced generally parallel *tubular* header and tank constructions;

each of said header and tank constructions having *a cross section in the form of a closed curve and having* elongated, spaced, tube receiving holes in a header surface thereof;

the holes in one header surface being aligned with and facing corresponding holes in the other header surface; and elongated open ended, flattened tubes extending between and into said header and tank constructions through aligned ones of said holes;

the portions of each header surface between said holes including exteriorly convex domes defined by *continuous* compound curves to thereby provide increased resistance to deformation as a result of force exerted by a pressurized fluid within said header and tank [construction]*constructions, said domes being located between all said holes and extending fully therebetween.*

*3. A heat exchanger comprising:*

*spaced generally parallel, generally cylindrical header and tank constructions;*

*each of said header and tank constructions having elongated, spaced, tube receiving holes in a header surface thereof;*

*the holes in one header surface being aligned with and facing corresponding holes in the other header surface; and*

*elongated open ended, flattened tubes extending between and into said header and tank construction through aligned ones of said holes;*

*the portions of each header surface between said holes including exteriorly convex domes defined by continuous compound curves having a curved appearance circumferentially of the header and tank construction and a curved appearance axially of the length of the header and tank construction to thereby provide increased resistance to deformation as a result of force exerted by pressurized fluid with said header and tank constructions, said domes being located between all said holes and extending fully therebetween.*

*4. The heat exchanger of claim 3 wherein said compound curves are nominal spheres.*

*5. The heat exchanger of claim 3 wherein each said header and tube tank construction is defined by a tube.*

* * * * *